US005234464A

United States Patent [19]

Zimmer et al.

[11] Patent Number: 5,234,464

[45] Date of Patent: Aug. 10, 1993

[54] METHOD OF DYEING TEXTILE WEBS WITH REACTIVE DYESTUFFS: SUCCESSIVE APPLICATIONS OF REACTIVE DYE AND ALKALI SOLUTIONS

[75] Inventors: Johannes Zimmer, Ebentaler Str. 133, A-9020 Klagenfurt; Hellmut Wöll, Strass im Strassertal, both of Austria

[73] Assignee: Johannes Zimmer, Klagenfurt, Austria

[21] Appl. No.: 581,691

[22] Filed: Sep. 12, 1990

[30] Foreign Application Priority Data

Sep. 12, 1989 [AT] Austria ..... 2134/89

[51] Int. Cl.[5] ..... D06P 3/66; C09B 62/00

[52] U.S. Cl. ..... 8/543; 8/444; 8/147; 8/917; 8/918

[58] Field of Search ..... 8/543, 542, 444

[56] References Cited

U.S. PATENT DOCUMENTS

| | | | |
|---|---|---|---|
| 3,663,156 | 5/1972 | Meininger et al. | 8/630 |
| 3,816,069 | 6/1974 | Andrew et al. | 8/549 |
| 4,270,236 | 6/1981 | Zurbuchen et al. | 8/159 |
| 4,340,387 | 7/1982 | Evans et al. | 8/580 |
| 4,701,182 | 10/1987 | von der Eltz et al. | 8/549 |
| 4,997,453 | 3/1991 | Kutz et al. | 8/502 |
| 5,196,032 | 3/1993 | Oschatz | 8/543 |

FOREIGN PATENT DOCUMENTS

| | | |
|---|---|---|
| 249022 | 12/1987 | European Pat. Off. . |
| 2003363 | 8/1970 | Fed. Rep. of Germany . |
| 3121043 | 3/1982 | Fed. Rep. of Germany . |
| 3242709 | 2/1984 | Fed. Rep. of Germany . |
| 3247612 | 7/1984 | Fed. Rep. of Germany . |
| 838336 | 6/1960 | United Kingdom . |
| 1238913 | 7/1971 | United Kingdom . |
| 1511684 | 5/1978 | United Kingdom . |

*Primary Examiner*—A. Lionel Clingman
*Attorney, Agent, or Firm*—Herbert Dubno

[57] ABSTRACT

A method of dyeing textile webs with reactive dyestuffs in which the dyestuff and alkali solutions are applied successively to the web separately and directly following one another in predetermined proportions to the dry weight of the web in a single machine pass.

5 Claims, 1 Drawing Sheet

METHOD OF DYEING TEXTILE WEBS WITH REACTIVE DYESTUFFS: SUCCESSIVE APPLICATIONS OF REACTIVE DYE AND ALKALI SOLUTIONS

FIELD OF THE INVENTION

Our present invention relates to a method of dyeing textile webs, i.e. woven, nonwoven or knitted fabrics, of cellulose fibers, wool and silk with reactive dyestuffs.

BACKGROUND OF THE INVENTION

Dyeing processes for textile webs utilizing reactive dyestuffs are generally known. One process is the so-called extraction process. This is carried out with full-width machines (jiggers) or hank-dyeing machines (reel dyers, jet dyeing machines and the like) with the step-wise addition of dyestuff and alkali to the dye bath, in conjunction with adjustment of the temperature. The disadvantage of this process is that it is discontinuous and can only accommodate limited batch sizes. There is a danger with these earlier systems, moreover, that the ends and edges of the web will be nonuniformly dyed. In addition, these processes are very time-consuming.

A further known process is the so-called two-phase process. In this process the dyestuff is applied by padding with a padding machine or foulard, the padded web is subjected to intervening drying, the alkali is then applied and the dye is fixed by thermal treatment, steam treatment or the lapse of an appropriate holding time. This process has been found to be interesting only for large dye batches since it involves handling between the two application steps.

Another known process is the so-called padding-cold-storage process. This process has, because of its relative simplicity, received great attention in recent years. The dyestuff and alkali are applied in a common dye liquor and the dyed goods are stored for a considerable length of time in a rolled-up state before washing out the excess of the dye so that the dye reaction is complete during the cold-storage state. Because of the instability of alkali dye liquors containing reactive dyestuffs, the dyestuff solution and alkali must be proportionally mixed only shortly before application of the composition by the padding machine or foulard.

Residual dye liquor and the contents of the padding machine are not reusable and create problems when discharged into waste water or with respect to sewage treatment. As a consequence, the use of this process for small or average-sized batches is not rational and, because the process cannot be carried out in a continuous manner, the suitability for large batch dyeing is limited. Nevertheless, the padding-cold-storage process has represented a major advance in reactive piece dyeing to the point that today approximately 70 to 80% of all fabrics dyed with reactive dyes are dyed utilizing this process.

The process has found wide utility because of its great simplicity and in spite of the greater economic and ecological challenge provided by the process.

The padding liquor contains, in addition to the dissolved reactive dyestuff and alkali, high proportions of water glass ($Na_2SiO_3$) which is required for stabilizing the reactive composition. The water glass not only provides a substantial load for the waste water but tends to deposit in ducts, pipes and conduits through which the composition may be passed. The residual mixed liquor from the padding machine at the conclusion of the dyeing operation is discharged into waste water and is no longer usable. The water glass tends to deposit upon the padding machine and deflecting rolls to create encrustations and problems A major disadvantage of the presence of water glass, moreover, is the difficulty which arises in trying to wash out water glass from the fabric after the storage time which can require considerable wash water and energy for the washing process.

Numerous attempts have been made in the past to replace the water glass without success and considerable research is yet under way to attempt to find dyeing processes which do not require the presence of the water glass.

OBJECTS OF THE INVENTION

It is, therefore, the principal object of the present invention to provide a process for dyeing webs and fabrics of the type described as reactive dyestuffs, whereby the aforementioned disadvantages are avoided.

Still another object of the invention is to provide a dyeing process which does not require the use of water glass as a stabilizer, which eliminates the high water and energy costs of subsequent washing of the fabric and which can be carried out with the ease and simplicity of earlier reactive dyeing techniques.

SUMMARY OF THE INVENTION

These objects and others which will become apparent hereinafter are attained, in accordance with the present invention, in a method which comprises applying the reactive dyestuff solution and the alkali solution directly after one another in predetermined (precisely defined) quantities with respect to the dry weight of the fabric in a single machine pass, so that the two applications amount to less than 100% of the dry weight of the web and so that the weights of each application total about 80 to 100% of the dry weight of the fabric or web.

According to another feature of the invention, the application of the reactive dye solution (e.g. the impregnation of the fabric with the reactive dyestuff solution) is effected by immersion in a bath thereof followed by squeezing so that the fabric contains about 80 to 90% of the total application with respect to the dry weight of the fabric or web, whereupon the application of the alkali solution, preferably in the same travel or path of the web, involves a minimum-quantity application of a predetermined quantity of the alkali so that it makes up about 10 to 40% with respect to the dry weight of the fabric.

With the system of the invention, the dyestuff solution and the alkali solution are separately applied in a single machine operation directly one after the other and continuously.

The process requires that exactly defined and reproducible liquid quantities are uniformly applied in a certain percent proportion to the weight of the fabric or web and in two directly following applications. The applications can be by the Magnoroll or magnetic padding machine or magnet foulard apparatus in which two Magnoroll units can be directly connected to form a single machine unit.

BRIEF DESCRIPTION OF THE DRAWINGS

The above and other objects, features and advantages of the present invention will become more readily apparent from the following description, reference being made to the accompanying drawing in which.

SPECIFIC DESCRIPTION AND EXAMPLE

Figure 1:
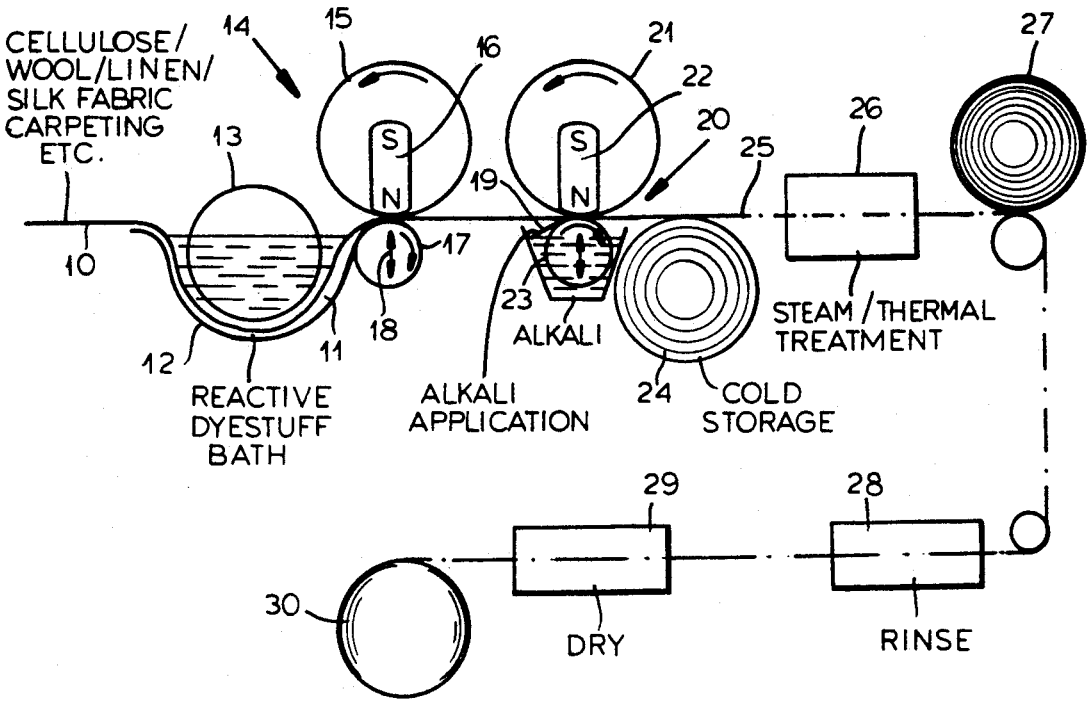
FIG. 1 is a diagram illustrating the practice of the invention in a very simplified form.

According to the invention, as illustrated in FIG. 1, the fabric or web 10 of cellulose fibers, wool, linen, silk or the like is passed through a bath 11 containing a reactive dyestuff by immersion, e.g. through a trough 12, in which the fabric is guided by a drum or reel 13. Immediately thereafter, the fabric is squeezed in a first Magnoroll squeezing unit 14 represented by a rotating drum 15 containing a magnetic beam 16 juxtaposed with a magnetically attractable squeezing roller 17 which is mounted to move in the direction represented by the arrows 18. The squeezing is so effected that the residual dyestuff liquid retained by the web constitutes 60 to 90% by weight thereof.

Immediately thereafter, the alkali solution is applied, as represented at 19, and the fabric is squeezed again by the second Magnoroll assembly 20 which comprises a drum 21, a magnetic beam 22 and a magnetically attractable roller 23 to squeeze the excess alkali from the fabric.

The fabric at this point contains a dyestuff mixture of the reactive dyestuff and the alkali solution equal to 80 to 90% of the dry weight of the fabric, the alkali being added at a rate of 10 to 40% of the dry weight of the fabric at 19.

If a discontinuous process is desired, the fabric can be rolled up at 24 and stored in a cold environment until the dyestuff reaction is complete. If a continuous process is desired, the fabric may be fed as represented at 25 to a steam or thermal treatment chamber 26 before it is rolled up at 27. Instead of rolling up the fabric at 27, on-line rinsing and drying can, if desired, be used. In that case, the fabric can be passed through a conventional rinsing stage 28 followed by a drying stage 29 before being rolled up at 30.

The first stage application of the dyestuff solution can be effected without immersion of the fabric or web and in all cases the second application, namely, the application of the alkali solution should be effected without immersion to avoid loss of dyestuff into the alkali solution from the web.

Figure 2:
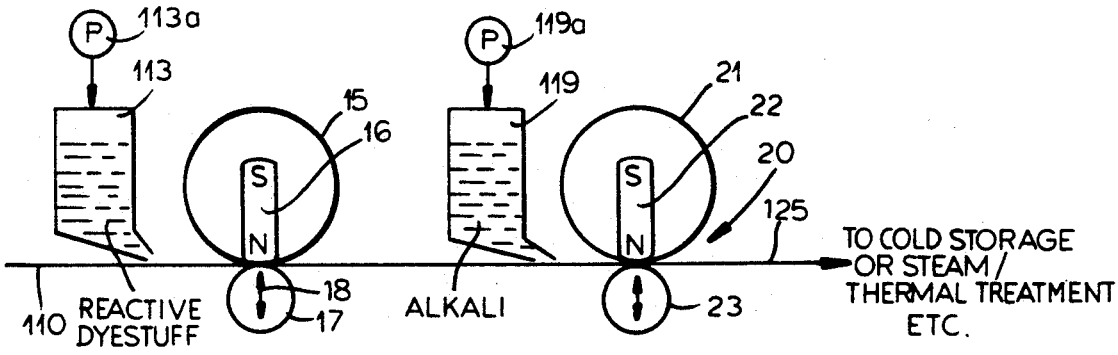
FIG. 2 is a diagram illustrating a modification thereof.

For example, in FIG. 2, the reactive dyestuff is applied to the web 110 by a nonimmersion method, e.g. from a full machine width nozzle 113 pressurized by a pump 113*a* and thus forming a metering device which allows careful control of the amount of the reactive dyestuff applied.

In this instance, the Magnoroll arrangement 15–18, which can correspond to that of FIG. 1, simply presses the reactive dyestuff thoroughly into the web without squeezing out any of the dyestuff. Consequently, the reactive dyestuff remaining in the web upon application of the alkali, is controlled by a metering operation.

In the embodiment of FIG. 2 as well, the alkali, instead of being applied to the web by the Magnoroll arrangement 20, can be metered onto the web by another full machine width nozzle arrangement 119 and pump 119*a* and pressed into the web by the Magnoroll arrangement 20. The web 125 emerging from this stage, can be subjected to cold storage, steam or other thermal treatment and/or to washing and drying in the manner previously described.

By variation of the proportions of dyestuff solution and alkali solution and the quantities used in accordance with the aforementioned parameters, the process can be employed for all kinds of textile fabrics including cotton, viscose, linen, wool and silk and mixtures thereof. While rolling up for cold storage is preferred, as described, the fabric can also be continuously thermally treated and then washed.

Mention should be made of the fact that while cotton, viscose linen, wool and silk are the preferred fabrics to which the invention is applicable, the invention may be used with fabrics composed of any fibers which can be dyed with reactive dyestuff and, indeed, for all kinds of fabrics, namely, woolen fabrics, knitted fabrics, nonwoven fabrics, carpeting and the like.

The bath or solution temperatures which may be used are those which are common in reactive dying and the invention can employ any reactive dyestuff for the particular fibers with which such reactive dyestuffs have been used heretofore.

The pressing pressure following application of the reactive dyestuff will be independent of the residual moisture content of the fabric which can be 70 to 90% or more, as desired, and is generally dependent upon the type and thickness of the fabric used.

The cold storage can take place by slowly rotating the roll for a period of about 24 hours, whereupon the fabric is washed and the heat treatment may involve hot air treatment in addition to steam treatment or as an alternative to steam treatment in appropriate chambers.

The process of the invention has the following advantages:

(a) Suitability for all cellulose fibers as well as wool and silk.

(b) Long shelf time for the liquors or solutions used in the treatment.

(c) Practically no dyestuff or alkali losses since the dyestuff liquors remain alkali-free and can be reused repeatedly.

(d) The process is environmentally sound since practically no dyestuff reaches waste water and the amounts of the solutions used are very small.

(e) Utilizing application by a ordinary padding machine, at least 30 liters of the liquor are required for trough filling as compared to 4 to 5 liters for a trough for applying the reactive dyestuff solution in accordance with the invention.

(f) For most dyestuffs, the process of the invention provides a better dyestuff yield and especially deeper color tones.

(g) The addition of water glass (sodium silicate) to the alkali can be eliminated so that the dyed product can be more readily washed.

(h) The process is suitable for batch sizes from the smallest to very large batches.

The new dyeing process of the invention is ecologically and economically sound because it operates without the use of water glass and need not dispose of residual liquors which can become environmental loads.

We claim:

1. A reactive-dyeing method for dyeing a textile web of a reactive-dyeing fiber selected from the group which consists of cotton, viscose, linen, wool and silk, comprising the steps of:

(a) separately providing an aqueous reactive dyestuff solution and an alkali solution so that they are applicable to a textile web to be dyed separately from one another and are free from water glass, dyestuff being present in said dyestuff solution in an effective amount to dye said web and alkali being present in said alkali solution in an effective amount to be reactive with said dyestuff in a reactive-dyeing reaction; and (b) dyeing said web of said reactive-dyeing fiber with said solutions in an single machine pass continuously by the steps of:

($b_1$) initially passing said web continuously through said bath of said aqueous reactive dyestuff solution, ($b_2$) thereafter and directly following said bath continuously squeezing aqueous reactive dyestuff solution from said web by a squeezing roll to leave a quantity of the aqueous reactive dyestuff solution impregnating said web in an amount of 60 to 90% of a dry weight thereof, and ($b_3$) without intervening drying continuously applying to said web without immersion thereof a quantity of said alkali solution amounting to 10 to 40% of said dry weight of said web so that the total amount of said solutions applied to said web is 80% to 100% of the dry weight thereof and said quantities are independent of concentrations of said solutions; and (c) permitting said solutions on said web to react and dye said web.

2. The method defined in claim 1 wherein said alkali solution is present in an effective amount such that when applied complete diffusion and impregnation with uniform reaction with said reactive dyestuff solution is effected in all parts of a thickness of said web.

3. The method defined in claim 1 wherein said alkali solution is applied in an effective amount so that a dyestuff/alkali reaction is limited to a side of said web and that said web is so treated that at least one outer side of said web is colored with greater intensity than an inner region of a thickness thereof.

4. The method defined in claim 1 wherein said squeeze roller includes a magnetic device for controlling a pressing force against said web.

5. The method defined in claim 4 wherein said pressure roller includes a magnetic device for controlling a pressing force against said web.

* * * * *